United States Patent [19]

Larson et al.

[11] Patent Number: 4,681,831

[45] Date of Patent: Jul. 21, 1987

[54] CHARGEABLE RESINS FOR LIQUID ELECTROSTATIC DEVELOPERS COMPRISING PARTIAL ESTER OF 3-HYDROXYPROPANESULFONIC ACID

[75] Inventors: James R. Larson; Torence J. Trout, both of Wilmington, Del.

[73] Assignee: E. I. Du Pont de Nemours and Company, Wilmington, Del.

[21] Appl. No.: 880,155

[22] Filed: Jun. 30, 1986

[51] Int. Cl.[4] ..... G03G 9/12

[52] U.S. Cl. ..... 430/114

[58] Field of Search ..... 430/114

[56] References Cited

U.S. PATENT DOCUMENTS

| | | | |
|---|---|---|---|
| 3,788,995 | 1/1974 | Stahly et al. | 430/114 X |
| 3,849,165 | 11/1974 | Stahly et al. | 430/114 X |
| 4,081,391 | 3/1978 | Tsubuko et al. | 430/114 |
| 4,170,563 | 10/1979 | Merrill et al. | 430/114 X |
| 4,171,275 | 10/1979 | Merrill et al. | 430/114 X |
| 4,202,785 | 5/1980 | Merrill et al. | 430/106 |
| 4,229,513 | 10/1980 | Merrill et al. | 430/115 |
| 4,522,908 | 6/1985 | de Winter et al. | 430/114 |

*Primary Examiner*—J. David Welsh

[57] ABSTRACT

A liquid electrostatic developer containing negatively chargeable resin particles with improved charging characteristics, said developer consisting essentially of (A) nonpolar liquid having a Kauri-butanol value of less than 30, present in a major amount, (B) nonpolar liquid soluble ionic or zwitterionic charge director compound, and (C) resin particles of a polymer containing at least one acidic constituent having a pKa less than 4.5, preferably 3.0, at 25° C. in water and an acid number due to said acidic constituent of at least one. The average resin particle size by area is less than 10 μm. Optionally a colorant and other additives or adjuvants are present. The liquid electrostatic developer is useful in copying making proofs including digital color proofs, lithographic printing plates, and resists.

18 Claims, No Drawings

CHARGEABLE RESINS FOR LIQUID ELECTROSTATIC DEVELOPERS COMPRISING PARTIAL ESTER OF 3-HYDROXYPROPANESULFONIC ACID

DESCRIPTION

Technical Field

This invention relates to liquid electrostatic developers having improved charging characteristics. More particularly this invention relates to a liquid electrostatic developer containing as a constituent an improved negatively chargeable resin.

Background Art

It is known that a latent electrostatic image can be developed with toner particles dispersed in an insulating nonpolar liquid. Such dispersed materials are known as liquid toners or liquid developers. A latent electrostatic image may be produced by providing a photoconductive layer with a uniform electrostatic charge and subsequently discharging the electrostatic charge by exposing it to a modulated beam of radiant energy. Other methods are known for forming latent electrostatic images. For example, one method is providing a carrier with a dielectric surface and transferring a preformed electrostatic charge to the surface. Useful liquid toners comprise a thermoplastic resin and dispersant nonpolar liquid. Generally a suitable colorant is present such as a dye or pigment. The colored toner particles are dispersed in the nonpolar liquid which generally has a high-volume resistivity in excess of $10^9$ ohm centimeters, a low dielectric constant below 3.0 and a high vapor pressure. The toner particles are less than 10 μm average by area size. After the latent electrostatic image has been formed, the image is developed by the colored toner particles dispersed in said dispersant nonpolar liquid and the image may subsequently be transferred to a carrier sheet.

Since the formation of proper images depends on the differences of the charge between the liquid developer and the latent electrostatic image to be developed, it has been found desirable to add a charge director compound to the liquid toner comprising the thermoplastic resin, dispersant nonpolar liquid and generally a colorant. Such liquid developers provide images of good resolution, but it has been found that the charging and image quality are particularly pigment dependent. For example, liquid electrostatic developers wherein copolymers of polyethylene/carboxylic acid are used to form the resin particles provide good image quality particularly when pigments are present in the formulation. Removal of the pigment, however, normally results in poor charging and resultant poor images. Although charging of such developers can be improved for unpigmented developers or those containing black pigment by the addition of silica, it has been found that developers of this type containing cyan and magenta colorants, for example, do not charge adequately even in the presence of added silica.

It has been found that the above disadvantages can be overcome and liquid electrostatic developers prepared containing ionic or zwitterionic compound soluble in nonpolar liquid which have improved negative charging characteristics, improved image quality, reduced squash, improved solid area coverage independent of pigment.

DISCLOSURE OF THE INVENTION

In accordance with this invention there is provided a liquid electrostatic developer containing negatively chargeable resin particles with improved charging characteristics, said developer consisting essentially of (A) nonpolar liquid having a Kauri-butanol value of less than 30, present in a major amount, (B) nonpolar liquid soluble ionic or zwitterionic charge director compound, and (C) resin particles of a polymer containing at least one acidic constituent having a pKa of less than 4.5 measured at 25° C. in water and an acid number due to said acidic constituent of at least one, the resin particles having an average by area particle size of less than 10 μm.

Throughout the specification the below-listed terms have the following meanings:

In the claims appended hereto "consisting essentially of" means the composition of the liquid electrostatic developer does not exclude unspecified components which do not prevent the advantages of the developer from being realized. For example, in addition to the primary components, there can be present additional components, such as a colorant, adjuvant, e.g., polyhydroxy compound, aminoalcohol, polybutylene succinimide, aromatic hydrocarbon, metallic soap, etc.

Squash means the blurred edges of the image.

Acid number is the milligrams of potassium hydroxide required to neutralize 1 gram of polymer.

Conductivity is the conductivity of the developer measured in picomhos (pmho)/cm at 5 hertz and 5 volts.

The dispersant nonpolar liquids (A) are, preferably, branched-chain aliphatic hydrocarbons and more particularly, Isopar®-G, Isopar®-H, Isopar®-K, Isopar®-L, Isopar®-M and Isopar®-V. These hydrocarbon liquids are narrow cuts of isoparaffinic hydrocarbon fractions with extremely high levels of purity. For example, the boiling range of Isopar®-G is between 157° C. and 176° C., Isopar®-H between 176° C. and 191° C., Isopar®-K between 177° C. and 197° C., Isopar®-L between 188° C. and 206° C. and Isopar®-M between 207° C. and 254° C. and Isopar®-V between 254.4° C. and 329.4° C. Isopar®-L has a mid-boiling point of approximately 194° C. Isopar®-M has a flash point of 80° C. and an auto-ignition temperature of 338° C. Stringent manufacturing specifications, such as sulphur, acids, carboxyl, and chlorides are limited to a few parts per million. They are substantially odorless, possessing only a very mild paraffinic odor. They have excellent odor stability and are all manufactured by the Exxon Corporation. High-purity normal paraffinic liquids, Norpar®12, Norpar®13 and Norpar®15, Exxon Corporation, may be used. These hydrocarbon liquids have the following flash points and auto-ignition temperatures:

| Liquid | Flash Point (°C.) | Auto-Ignition Temp (°C.) |
|---|---|---|
| Norpar® 12 | 69 | 204 |
| Norpar® 13 | 93 | 210 |
| NorPar® 15 | 118 | 210 |

All of the dispersant nonpolar liquids have an electrical volume resistivity in excess of $10^9$ ohm centimeters and a dielectric constant below 3.0. The vapor pressures at 25° C. are less than 10 Torr. Isopar ®-G has a flash point, determined by the tag closed cup method, of 40° C., Isopar ®-H has a flash point of 53° C. determined by ASTM D 56. Isopar ®-L and Isopar ®-M have flash points of 61° C., and 80° C., respectively, determined by the same method. While these are the preferred dispersant nonpolar liquids, the essential characteristics of all suitable dispersant nonpolar liquids are the electrical volume resistivity and the dielectric constant. In addition, a feature of the dispersant nonpolar liquids is a low Kauri-butanol value less than 30, preferably in the vicinity of 27 or 28, determined by ASTM D 1133. The ratio of thermoplastic resin to dispersant nonpolar liquid is such that the combination of ingredients becomes fluid at the working temperature.

Useful resins within the scope of this invention as defined above containing at least one acidic constituent having a pKa of less than 4.5, preferably a pKa of less than 3.0, measured at 25° C. in water, can be prepared, for example, by the following methods:

(1) copolymerization of (a) at least one acidic monomer containing said acidic constituent with (b) at least one other monomer;

(2) attaching said acidic constituent to a polymeric material or reacting said acidic constituent with the polymeric material; and (3) polymerizing a monomer having said acidic constituent.

Other methods of preparing the resins are known to those skilled in the art.

Illustrative of method (1) above the following monomeric constituents can be used, for example, to prepare the resins:

(a) monomers having an acidic constituent include, but are not limited to, the following compounds: vinylsulfonic acid, styrene sulfonic acid, 2-acrylamido-2-methyl-1-propanesulfonic acid, 1-chloroacrylic acid, 1-trifluoromethacrylic acid, sulfoethylacrylate, sulfopropylacrylate, sulfobutylacrylate, sulfoethylmethacrylate, sulfopropylmethacrylate, sulfobutylmethacrylate, ethyl hydrogen p-vinylbenzylphosphonate, vinylphosphonic acid (preparation of the latter two is described in Merrill et al. U.S. Pat. No. 4,170,563), etc. It is also possible that the salts of acidic monomers such as $Li^+$, $Na^+$, $K^+$, $NR_4^+$, where R is hydrogen or alkyl, $Mg^{+2}$, $Ca^{+2}$, etc., can be used and then converted to the acidic form by ion exchange or other methods known to those skilled in the art;

(b) monomers of this type include, but are not limited to, the following compounds: ethylene, propylene, butylene, isobutylene, acrylates with a side chain of 2 to 30 carbon atoms, methacrylates with a side chain of 2 to 30 carbon atoms, styrene, vinyltoluene, 4-octylstyrene, vinylnaphthalene, acrylamides with side chains of 2 to 30 carbon atoms, and mixtures thereof, etc.

Additional monomers that can also be included in the resin to give desired solubility and processing properties set forth below include, for example, butadiene, isoprene, methylacrylate, methylmethacrylate, vinylalcohol, vinylmethylketone, vinylacetate, vinylpropionate, vinylbenzoate, vinylstearate, etc., acrylic and methacrylic acid, chlorinated ethylene, fluoronated ethylene, vinylbromide, acrylonitrile, chlorostyrene and mixtures thereof, etc.

Illustrative of method (2) above to prepare the resins include:

(1) A procedure of Marvel and Wright [J. Poly. Sci. 8, 495 (1952)] wherein the addition of phosphorous trichloride to a ketone containing polymer followed by hydrolysis yields a hydroxyphosphonic acid. Examples of ketone containing polymers are copolymers of ethylene, propylene, butylene, isobutylene, acrylates with a side chain of 2 to 30 carbon atoms, methacrylates with a side chain of 2 to 30 carbon atoms, styrene, vinyltoluene, vinylnaphthalene, acrylamides with side chains of 2 to 30 carbon atoms, methacrylamides with side chains of 2 to 30 carbon atoms, and mixtures thereof with ketone containing monomers such as vinyl methyl ketone, vinyl hexyl ketone, methyl isopropenyl ketone, etc.

(2) The acid chloride of a carboxylic acid containing polymer can be reacted with acidic materials such as 3-hydroxypropanesulfonic acid, p-hydroxybenzenesulfonic acid, 1-hydroxyethane-1,1-diphosphonic acid, etc.

An example of this is provided in Example 1.

(3) Partial sulfonation of an unsaturated polymer by the procedure described in Wagensommer U.S. Pat. No. 4,532,302, e.g., ethylene(53%)/propylene(43.5%)/1,4-hexadrine(3.5%), the percentages being by weight, etc.

Preferred compounds that may be prepared by a procedure set out above include:

(1) partial ester of 3-hydroxypropanesulfonic acid and copolymer of ethylene and $\alpha,\beta$-ethylenically unsaturated acid, e.g., acrylic acid, methacrylic acid, having an acid number of $7\pm3$ based on the 3-hydroxypropanesulfonic acid;

(2) poly(styrene/2-acrylamido-2-methyl-1-propanesulfonic acid) (95% by weight/5% by weight) having an acid number of 13.

In addition, the resins have the following characteristics:

1. Be able to disperse any colorant, e.g., pigment, that may be present
2. Be substantially insoluble in the dispersant (nonpolar) liquid (A) at temperatures below 40° C., so that the resin will not dissolve or solvate in storage.
3. Be able to solvate at temperatures above 50° C.,
4. Be able to be ground to form particles between 0.1 μm and 5 μm, in diameter,
5. Be able to form a particle (average by area) of less than 10 μm, e.g., determined by Horiba CAPA-500 centrifugal automatic particle analyzer, manufactured by Horiba Instruments, Inc., Irvine, CA: solvent viscosity of 1.24 cps, solvent density of 0.76 g/cc, sample density of 1.32 using a centrifugal rotation of 1,000 rpm, a particle size range of 0.01 to less than 10 μm, and a particle size cut of 1.0 μm.
6. Be able to fuse at temperatures in excess of 70° C.

By solvation in 3. above, the resins forming the toner particles will become swollen or gelatinous.

Components (A) and (C) are present in the liquid electrostatic developer in the following amounts:

Component (A): 85.0 to 99.9% by weight, preferably 97.0 to 99.5% by weight; and

Component (C): 0.1 to 15.0% by weight, preferably 0.5 to 3.0% by weight, based on the total weight of the developer.

Suitable nonpolar liquid soluble ionic or zwitterionic charge director compounds (B), which are generally used in an amount of 1 to 1000 mg/g, preferably 1 to 250 mg/g developer solids, include: negative charge directors, e.g., lecithin, Basic Calcium Petronate ®, Basic Barium Petronate ® oil-soluble petroleum sulfonate, manufactured by Sonneborn Division of Witco Chemical Corp., New York, NY, alkyl succinimide (manufactured by Chevron Chemical Company of California), etc.

As indicated above, an additional component that can be present in the electrostatic liquid developer are colorants, such as pigments or dyes and combinations thereof, which are preferably present to render the latent image visible, though this need not be done in some applications. The colorant, e.g., a pigment, may be present in the amount of up to about 60 percent by weight based on the total weight of developer solids (generally resin unless other solids are present), preferably 0.01 to 30% by weight based on the total weight of developer solids. The amount of colorant may vary depending on the use of the developer. Examples of pigments are Monastral® Blue G (C.I. Pigment Blue 15 C.I. No. 74160), Toluidine Red Y (C.I. Pigment Red 3), Quindo® Magenta (Pigment Red 122), Indo® Brilliant Scarlet (Pigment Red 123, C.I. No. 71145), Toluidine Red B (C.I. Pigment Red 3), Watchung® Red B (C.I. Pigment Red 48), Permanent Rubine F6B13-1731 (Pigment Red 184), Hansa® Yellow (Pigment Yellow 98), Dalamar® Yellow (Pigment Yellow 74, C.I. No. 11741), Toluidine Yellow G (C.I. Pigment Yellow 1), Monastral® Blue B (C.I. Pigment Blue 15), Monastral® Green B (C.I. Pigment Green 7), Pigment Scarlet (C.I. Pigment Red 60), Auric Brown (C.I. Pigment Brown 6), Monastral® Green G (Pigment Green 7), Carbon Black, Cabot Mogul L (black pigment C.I. No. 77266) and Stirling NS N 774 (Pigment Black 7, C.I. No. 77266).

It is known that fine particle size oxides, e.g., silica, alumina, titania, etc.; preferably in the order of 0.5 μm or less can be dispersed into the liquefied resin used in liquid electrostatic developers. The presence of such oxide particles is not necessary to aid the charging of the developers.

Another additional component of the electrostatic liquid developer is an adjuvant which can be taken from the group of polyhydroxy compound which contains at least 2 hydroxy groups, aminoalcohol, polybutylene succinimide, aromatic hydrocarbon having a Kauributanol value of greater than 30, and metallic soap. The adjuvants, other than metallic soap, are generally used in an amount of 1 to 1000 mg/g, preferably 1 to 200 mg/g developer solids. The metallic soap, when present, is useful in an amount of 0.01 to 60 percent by weight based on the total weight of the developer solids. Examples of the various above-described adjuvants include:

polyhydroxy compounds: ethylene glycol, 2,4,7,9-tetramethyl-5-decyn-4,7-diol, poly(propylene glycol), pentaethylene glycol, tripropylene glycol, triethylene glycol, glycerol, pentaerythritol, glycerol-tri-12 hydroxystearate, ethylene glycol monohydroxystearate, propylene glycerol monohydroxystearate, etc.

aminoalcohol compounds: triisopropanolamine, triethanolamine, ethanolamine, 3-amino-1-propanol, o-aminophenol, 5-amino-1-pentanol, tetra(2-hydroxyethyl)ethylenediamine, etc.

polybutylene/succinimide: OLOA®-1200 sold by Chevron Corp., analysis information appears in Kosel U.S. Pat. No. 3,900,412, column 20, lines 5 to 13, incorporated herein by reference; Amoco 575 having a number average molecular weight of about 600 (vapor pressure osmometry) made by reacting maleic anhydride with polybutene to give an alkenylsuccinic anhydride which in turn is reacted with a polyamine. Amoco 575 is 40 to 45% surfactant, 36% aromatic hydrocarbon, and the remainder oil, etc.

aromatic hydrocarbon: benzene, toluene, naphthalene, substituted benzene and naphthalene compounds, e.g., trimethylbenzene, xylene, dimethylethylbenzene, ethylmethylbenzene, propylbenzene, Aromatic 100 which is a mixture of $C_9$ and $C_{10}$ alkyl-substituted benzenes manufactured by Exxon Corp., etc.

metallic soap: aluminum tristearate, aluminum distearate, barium, calcium, lead and zinc stearates; cobalt, manganese, lead and zinc linoleates; aluminum, calcium and cobalt octoates, calcium and cobalt oleates, zinc palmitate, calcium, cobalt, manganese, lead and zinc naphthenates, calcium, cobalt, manganese, lead and zinc resinates, etc. The metallic soap is dispersed in the thermoplastic resin as described in Trout U.S. application Ser. No. 857,326, filed Apr. 30, 1986.

The particles in the electrostatic liquid developer have an average by area particle size of less than 10 μm, preferably the average by area particle size is less than 5 μm. The resin particles of the developer may or may not be formed having a plurality of fibers integrally extending therefrom. The term "fibers" as used herein means toner particles formed with fibers, tendrils, tentacles, threadlets, fibrils, ligaments, hairs, bristles, or the like.

The electrostatic liquid developer can be prepared by a variety of processes. For example, into a suitable mixing or blending vessel, e.g., attritor, heated ball mill, heated vibratory mill such as a Sweco Mill manufactured by Sweco Co., Los Angeles, CA, equipped with particulate media, for dispersing and grinding, Ross double planetary mixer manufactured by Charles Ross and Son, Hauppauge, NY, etc., or a two roll heated mill (no particulate media necessary) are placed at least one of resin, and dispersant nonpolar liquid described above. Generally the resin, dispersant nonpolar liquid and optional colorant are placed in the vessel prior to starting the dispersing step. Optionally the colorant can be added after homogenizing the resin and the dispersant nonpolar liquid. Polar additive can also be present in the vessel, e.g., up to 100% based on the weight of polar additive and dispersant nonpolar liquid. The dispersing step is generally accomplished at elevated temperature, i.e., the temperature of ingredients in the vessel being sufficient to plasticize and liquefy the resin but being below that at which the dispersant nonpolar liquid or polar additive, if present, degrades and the resin and/or colorant decomposes. A preferred temperature range is 80° to 120° C. Other temperatures outside this range may be suitable, however, depending on the particular ingredients used. The presence of the irregularly moving particulate media in the vessel is preferred to prepare the dispersion of toner particles. Other stirring means can be used as well, however, to prepare dispersed toner particles of proper size, configuration and morphology. Useful particulate media are particulate materials, e.g., spherical, cylindrical, etc. taken from the class consisting of stainless steel, carbon steel, alumina, ceramic, zirconium, silica, and sillimanite. Carbon steel particulate media is particularly useful when colorants other than black are used. A typical diameter range for the particulate media is in the range of 0.04 to 0.5 inch (1.0 to ~13 mm).

After dispersing the ingredients in the vessel, with or without a polar additive present until the desired dispersion is achieved, typically 1 hour with the mixture being fluid, the dispersion is cooled, e.g., in the range of 0° C.

to 50° C. Cooling may be accomplished, for example, in the same vessel, such as the attritor, while simultaneously grinding in the presence of additional liquid with particulate media to prevent the formation of a gel or solid mass; without stirring to form a gel or solid mass, followed by shredding the gel or solid mass and grinding, e.g., by means of particulate media in the presence of additional liquid; or with stirring to form a viscous mixture and grinding by means of particulate media in the presence of additional liquid. Additional liquid means dispersant nonpolar liquid, polar liquid or combinations thereof. Cooling is accomplished by means known to those skilled in the art and is not limited to cooling by circulating cold water or a cooling material through an external cooling jacket adjacent the dispersing apparatus or permitting the dispersion to cool to ambient temperature. The resin precipitates out of the dispersant during the cooling. Toner particles of average particle size (by area) of less than 10 μm, as determined by a Horiba CAPA-500 centrifugal particle analyzer described above or other comparable apparatus, are formed by grinding for a relatively short period of time.

After cooling and separating the dispersion of toner particles from the particulate media, if present, by means known to those skilled in the art, it is possible to reduce the concentration of the toner particles in the dispersion, impart an electrostatic negative charge to the toner particles, or a combination of these variations. The concentration of the toner particles in the dispersion is reduced by the addition of additional dispersant nonpolar liquid as described previously above. The dilution is normally conducted to reduce the concentration of toner particles to between 0.1 to 15 percent by weight, preferably 0.3 to 3.0, and more preferably 0.5 to 2 weight percent with respect to the dispersant nonpolar liquid. One or more nonpolar liquid soluble ionic or zwitterionic charge director compounds (B), of the type set out above, can be added to impart a negative charge. The addition may occur at any time during the process; preferably at the end of the process, e.g., after the particulate media, if used, are removed and the concentration of toner particles is accomplished. If a diluting dispersant nonpolar liquid is also added, the charge director compound can be added prior to, concurrently with, or subsequent thereto. If an adjuvant compound of a type described above has not been previously added in the preparation of the developer, it can be added prior to or subsequent to the developer being charged. Preferably the adjuvant compound is added after the dispersing step. A preferred mode of the invention is described in Example 1.

INDUSTRIAL APPLICABILITY

The liquid electrostatic developers of this invention demonstrate improved image quality, resolution, solid area coverage, and toning of fine details, evenness of toning, reduced squash independent of pigment present. The developers of this invention are useful in copying, e.g., making office copies of various colors as well as black and white; or color proofing, e.g., a reproduction of an image using the standard colors: yellow, cyan, magenta together with black, as desired. In copying and proofing the toner particles are applied to a latent electrostatic image. Other uses are envisioned for the electrostatic liquid developers include: digital color proofing, lithographic printing plates, and resists (generally nonpigmented).

EXAMPLES

The following controls and examples wherein the parts and percentages are by weight illustrate but do not limit the invention. In the examples, the melt indices were determined by ASTM D 1238, Procedure A; the average particle sizes by area were determined by a Horiba CAPA-500 centrifugal particle analyzer as described above; conductivities were measured in picomhos (pmho/cm) at five hertz and low voltage, 5.0 volts; and the densities were measured using a Macbeth densitometer model RD 918. Resolution is expressed in the Examples in line pairs/mm (lp/mm), and charging level is the ratio of mg of the charge director to grams of solids in the liquid developer.

EXAMPLE 1

A partial ester of 3-hydroxypropanesulfonic acid was prepared by the following procedure:

To a 4-neck 1000 ml round bottom flask fitted with a Dean Stark trap with condenser, mechanical stirrer, nitrogen inlet, and thermometer were added 50 grams of a copolymer of ethylene (89%) and methacrylic acid (11%) having a melt index of 100 at 190° C., and an acid No. of 66 and 500 ml of toluene. The mixture was heated to reflux with stirring. After 20 ml of distillate were collected in the trap, it was drained and 20 ml more of the distillate were collected. The reaction was cooled to 55° C. and 9.0 grams of 98% oxalyl chloride manufactured by Aldrich Chemical Company, Milwaukee, WI, were slowly added with stirring. After one hour, 12 grams of 80% aqueous 3-hydroxypropanesulfonic acid manufactured by Howard Hall International, Cos Cob, CT, were added and the mixture was stirred at 75° C. for 16 hours. The mixture was then cooled to 55° C. and poured into a 1000 ml of methanol. This gave 43 grams of the ester. IR analysis indicated 5% to 15% of the carboxylic acid functional groups were converted into the partial ester of 3-hydroxypropanesulfonic acid giving the resin an acid number due to said acid of 7±3.

A cyan liquid electrostatic developer was prepared using the following procedure:

In a Union Process 01 Attritor, Union Process Company, Akron, Ohio, was placed the following ingredients:

| Ingredient | Amount (g) |
|---|---|
| Partial ester of 3-hydroxy-propanesulfonic acid as prepared above | 30.0 |
| Monastral ® Blue BT 383D, Pigment Blue 15, C.I. Pigment No. 74160, E. I. du Pont de Nemours and Company, Wilmington, DE | 3.0 |
| Isopar ®-L, nonpolar liquid having a Kauri-butanol value of 27, Exxon Corporation | 140.0 |

The ingredients were heated to 110° C. and milled at maximum speed with 0.1875 (4.76 mm) diameter carbon steel balls for two hours. The attritor was cooled to room temperature while the milling was continued and then 125 grams of Isopar ®-H, nonpolar liquid having a Kauri-butanol value of 27, Exxon Corporation were added. Milling was continued for 15 hours resulting in toner particles with an average particle size by area of 1.2 μm. The carbon steel balls were removed and the dispersion of toner particles was then diluted to 2 percent solids by weight with additional Isopar ®-H. To 1.4 kg of this developer, 45 grams of a charge director such as 5.5% Basic Barium Petronate ® oil-soluble petroleum sulfonate, Sonneborn Division of Witco Chemical Corporation, New York, NY, were added. Image quality was determined using a Savin 870 copier at standard mode: Charging corona set at 6.8 kv and transfer corona at 8.0 kv using carrier sheets such as Savin 2200 paper, Plainwell offset enamel paper, number 3 glass, 60 lb. test, Plainwell Paper Co., Plainwell, MI. Results show a density of 2.0 for Plainwell offset enamel, with a resolution of 9 lp/mm, and 96% of the image transferred. A density of 1.1 was obtained with Savin 2200 office copier paper with a resolution of 9 lp/mm and 93% of the image transferred.

Control 1

The procedure of Example 1 was repeated with the following exception: Copolymer of ethylene (89%) and methacrylic acid (11%) having a melt index of 100 at 190° C. and an acid no. of 66 was used in place of the partial ester of 3-hydroxypropanesulfonic acid. To 1.4 kg of the diluted developer, 46 grams of Basic Barium Petronate ® described in Example 1 were added. Image quality was obtained in the Savin 870 copier as described in Example 1. An unreadable copy was obtained on Plainwell offset enamel, and only 37% of the image was transferred. A density of 0.1 was obtained on Savin 2200 office copier paper with a resolution of 2 lp/mm and 10% of the image transferred.

EXAMPLE 2

Four magenta liquid electrostatic developers were prepared using the following procedure:

In a Union Process 01 Attritor, Union Process Company, Akron, Ohio, was placed the following ingredients:

| Ingredient | Amount (g) |
|---|---|
| Resin as in Table 1 below | 25.0 |
| Mobay RV-6803, magenta pigment, Mobay Chemical Corp., Haledon, NJ | 2.7 |
| Isopar ®-L, nonpolar liquid having a Kauri-butanol value of 27, Exxon Corp. | 125.0 |

The ingredients were heated to 110° C. and milled at maximum rotor speed with 0.1875 inch (4.76 mm) diameter stainless steel balls for two hours. The attritor was cooled to room temperature while the milling was continued and then 125 grams to 150 grams (the amount varied according to the volume of the mixture) of Isopar ®-H, nonpolar liquid having a Kauri-butanol value of 27, Exxon Corporation were added. Milling was continued for 20 hours resulting in toner particles with an average particle size by area of 1 to 3 μm. The stainless steel balls were removed and the dispersion of toner particles was then diluted to 1.5 percent solids by weight with additional Isopar ®-H. To 1500 g of this developer, a charge director as described in Example 1 was added in the amounts indicated below. After conductivity of the dispersions had equilibrated (approximately 24 hours), image quality was determined using a Savin 870 copier at standard mode as described in Example 1 using carrier sheets as described in Example 1. The results are shown in Tables 1 and 2 below.

TABLE 1

| Sample | Resin | Average Particle Size (μm) | Charging Level | Conductivity |
|---|---|---|---|---|
| 1 | Partial ester of 3-hydroxypropanesulfonic acid as described in Example 1 | 1.5 | 221 | 72 |
| 2[1] | Ethylene sulfoethylmethacrylate copolymer, maximum % of sulfoethylmethacrylate (SEM) is 0.25%, Melt Index of 57 at 190° C. | 1.7 | 147 | 52 |
| 3 | Ethylene (89%) and methacrylic acid (11%) copolymer, Melt Index of 100 at 190° C., Acid No. is 66 (Control) | 0.9 | 147 | 56 |
| 3-A | Same as in 3 above (Control) | 0.9 | 221 | 80 |
| 4 | Polyethylene, Melt Index of 100 at 190° C. (Control) | 1.7 | 147 | 86 |

[1]Sample 2 was prepared as follows: 0.25 lb/hr SEM, 0.20 lb/hr acetone, 2.18 lb/hr cyclohexane, and 0.95 lb/hr t-butyl benzene were fed into a 750 ml reactor at 27,000 psi and 160° C. t-Butyl peroxypivalate was used as the initiator and was fed at an average rate of 325 × $10^{-6}$ lb/hr. The run was discontinued after two hours.

TABLE 2

| Sample- | Paper | Density | Resolution | Transfer Efficiency (%) |
|---|---|---|---|---|
| 1 | Offset Enamel | 1.34 | 10 | 94 |
| | Savin 2200 | 0.94 | 9 | 93 |
| 2 | Offset Enamel | 1.56 | 9 | 81 |
| | Savin 2200 | 1.06 | 9 | 82 |
| 3 | Offset Enamel | 1.60 | 8 | 93 |
| | Savin 2200 | 1.13 | 9 | 93 |
| 3-A | Offset Enamel | 0.91 | 9 | 98 |
| | Savin 2200 | 0.75 | 7 | 81 |
| 4 | Offset Enamel | 1.20 | 8 | 85 |
| | Savin 2200 | 0.60 | 8 | 59 |

Samples 3, 3-A, and 4 gave images that had poor squash, poor edge acuity, and nonuniform solid areas compared to images formed using Samples 1 and 2.

EXAMPLE 3

Example 2 was repeated with the following exceptions: 35 grams of resin were used, and 2.45 grams of a cyan pigment, Heucophthal Blue G XBT-583D Heubach, Inc., Newark, NJ, were used in place of the magenta pigment. Results are shown in Tables 3 and 4 below.

TABLE 3

| Sample | Resin | Average Particle Size (μm) | Charging Level | Conductivity |
|---|---|---|---|---|
| 1[1] | Ethylene sulfoethylmethacrylate copolymer, maximum % of sulfoethylmethacrylate (SEM) is 0.25%, Melt Index of 57 at 190° C. | 3.1 | 98 | 37 |
| 1-A | Same as in 1 above | 3.1 | 147 | 57 |
| 2 | Ethylene (90%) and methacrylic acid (10%) copolymer, | 0.6 | 98 | 48 |

TABLE 3-continued

| Sample | Resin | Average Particle Size (μm) | Charging Level | Conductivity |
|---|---|---|---|---|
| | Melt Index of 35 at 190° C., Acid No. is 60 (Control) | | | |
| 3 | Ethylene (89%) and methacrylic acid (11%) copolymer, Melt Index of 100 at 190° C., Acid No. is 66 (Control) | 1.0 | 98 | 43 |
| 3-A | Same as in 3 above (Control) | 1.0 | 147 | 89 |
| 4 | Same as in 3 above (Control) | 2.5 | 98 | 40 |
| 4-A | Same as in 3 above (Control) | 2.5 | 147 | 80 |
| 5 | Polethylene, Melt Index of 100 at 190° C. (Control) | 1.8 | 98 | 40 |
| 5-A | Same as in 5 above (Control) | 1.8 | 147 | 80 |

(1)Sample 1 preparation is described in footnote (1) after Table 1.

TABLE 4

| Sample- | Paper | Density | Resolution | Transfer Efficiency (%) |
|---|---|---|---|---|
| 1 | Offset Enamel | 2.2 | 6 | 95 |
| | Savin 2200 | 1.4 | 8 | 95 |
| 1-A | Offset Enamel | 2.2 | 8 | 92 |
| | Savin 2200 | 1.2 | 8 | 87 |
| 2 | Offset Enamel | Very poor image quality on both Offset Enamel and Savin 2200 paper. Essentially no toning took place. | | |
| 3 | Offset Enamel Savin 2200 | Results substantially the same as Sample 2. | | |
| 3-A | Offset Enamel Savin 2200 | Results substantially the same as Sample 2. | | |
| 4 | Offset Enamel Savin 2200 | Very poor image quality on both Offset Enamel and papers. Essentially no toning took place. | | |
| 4-A | Offset Enamel Savin 2200 | Results substantially the same as Sample 4. | | |
| 5 | Offset Enamel | 1.6 | 3 | 62 |
| | Savin 2200 | 0.5 | 6 | 35 |
| 5-A | Offset Enamel | 1.2 | 7 | 84 |
| | Savin 2200 | 0.8 | 7 | 73 |

EXAMPLE 4

The procedure described in Example 3 was repeated with the following exception: Lecithin (purified grade, Fischer Chemical Company, Pittsburgh, PA) was used as the charge director. Results are shown in Tables 5 and 6 below.

TABLE 5

| Sample | Resin | Average Particle Size (μm) | Charging Level | Conductivity |
|---|---|---|---|---|
| 1(1) | Ethylene sulfoethylmethacrylate copolymer, maximum % of sulfoethylmethacrylate (SEM) is 0.25%, Melt Index of 57 at 190° C. | 2.5 | 33 | 13 |
| 2(2) | Ethylene (90%) and methacrylic acid (11%) copolymer, Melt Index of 100 at 190° C., Acid No. is 66 | 1.8 | 33 | 17 |

(1)Sample 1 preparation is described in footnote (1) after Table 1.

(2)Sample 2 was prepared in a Union Process 1-S Attritor as described above with the following amounts of ingredients: resin = 200 g, pigment = 14 g, Isopar ®-L = 1000 g, Isopar ®-H = 700 g.

TABLE 6

| Sample | Paper | Density | Resolution | Transfer Efficiency (%) |
|---|---|---|---|---|
| 1 | Offset Enamel | 2.2 | 10 | 96 |
| | Savin 2200 | 0.4 | 9 | 40 |
| 2 | Offset Enamel | 0.8 | 10 | 100 |
| | Savin 2200 | 0.5 | 6 | 88 |

EXAMPLE 5

A cyan toner was prepared using the procedure described in Example 1 with the following exceptions: 3.5 grams of the pigment described in Example 3 were dispersed by two roll milling, in 50 grams of a copolymer of styrene (95%) and 2-acrylamido-2-methyl-1-propanesulfonic acid (AMPS) (5%) from Aldrich, Milwaukee, WI. Milling was at 180° C. for 45 minutes with cooling to 150° C. prior to removal from rollers.

The polymer with pigment dispersed therein was charged in a blender with liquid nitrogen. 40 grams of the chopped material were placed in a Union Process 01 Attritor with 125 grams of Isoar ®-L and 125 grams of Isopar ®-H and ground with cooling for 67 hours. Average particle size was 1.87 μm. The dispersion of toner was diluted to 2% solids with Isopar ®-H.

Lecithin charge director was added (35 mg/g of developer solids) resulting in conductivity of 31. Results show a density of 2.50 for Plainwell offset enamel, with a resolution of 10 to 11 lp/mm, and 99% transfer efficiency. A density of 1.49 was obtained with Savin 2200 office copier paper with resolution of 10 lp/mm, and 96% transfer efficiency. Compared to Control 2 below, polystyrene-co-AMPS resin when present in the liquid electrostatic developer showed improved resolution, squash, evenness of toning, transfer efficiency, and solid area coverage.

CONTROL 2

A cyan toner was prepared using the procedure described in Example 5 with the following exceptions: 7.0 grams of the pigment described therein were dispersed in 100 grams of polystyrene (Ultrafine Powder #15790) from Polysciences Inc., Warrington, PA, by two roll milling. Attritor grinding time was 145 hours yielding an average particle size of 1.14 μm. The dispersion of toner particles was diluted to 2% solids with Isopar ®-H.

Lecithin charge director added resulted in conductivity of 53. Results show a density of 1.90 for Plainwell offset enamel, with a resolution of 8 to 9 lp/mm, and 97% transfer efficiency. A density of 1.07 was obtained with Savin 2200 office copier paper with resolution of 9 to 10 lp/mm, and 83% transfer efficiency. Image showed high squash, unevenness of toning, and uneven solid area coverage.

EXAMPLE 6

Polyethylmethacrylate (Control resin A), polyethylmethacrylate (99%)/methacrylic acid (1%) (Control resin B), and polyethylmethacrylate (99%)/2-acrylamido-2-methyl-1-propanesulfonic acid (AMPS) (1%) (resin C) from Aldrich Chemical Co., Milwaukee, WI were prepared using the procedure described below:

Resin A: Part 1=700 g ethylmethacrylate, 300 g toluene; Part 2=300 g ethylmethacrylate; Part 3=3.5 g azobismethylethylacetonitrile, 700 g toluene; Part 4=500 g toluene.

Resin B: Part 1=697 g ethylmethacrylate, 3 g methacrylic acid, 300 g toluene; Part 2=293 g ethylmethacrylate, 7 g methacrylic acid; Part 3=3.5 g azobismethylethylacetonitrile and 700 g toluene; Part 4=500 g toluene.

Resin C: Part 1=697 g ethylmethacrylate, 3 g AMPS, 300 g toluene; Part 2=293 g ethylmethacrylate, 7 g AMPS, 400 g isopropanol; Part 3=300 g toluene, 3.5 g azobisdimethylvaleronitrile; Part 4=500 g isopropanol.

Part 1 was placed into a vessel in the presence of a nitrogen atmosphere and was heated to reflux (105° C.). At reflux were added simultaneously Part 2 (over 4 hours) and Part 3 (over 5 hours). When the addition of Part 3 was complete the mixture was heated for an additional hour, the heat was turned off and Part 4 was added to cool down the reaction.

6.54% By weight of cyan pigment as described in Example 3 was blended in each of the resins identified above using a two roll mill operating at 125° C. for 45 minutes. 40 grams of the pigmented resin and 250 grams of Isopar ®-L, nonpolar liquid having a Kauri-butanol value of 27, Exxon Corporation, were loaded in a Union Process 01 Attritor, Union Process Company, Akron, Ohio, along with 0.1875 inch (4.76 mm) diameter carbon steel balls and were milled at maximum speed for 6 days. Toner particles prepared from Control resin A had a particle size of 1.56 μm, toner particles prepared from Control resin B had a particle size of 1.88 μm, and toner particles prepared from resin C had a particle size of 1.48 μm. The toners were diluted to 1.5% with Isopar ®-H. To 1500 grams of the diluted toner were added 40 grams of 5.5% Basic Barium Petronate ® described in Example 1. The toners were tested on a Savin 870 copier as described in Example 1 with the following results. Toners prepared from Control resins A and B gave reverse images while toner prepared from resin C of this invention gave a right reading image.

EXAMPLE 7

A cyan toner is prepared using the following procedure: resin is prepared as described in Example 6, Control resin B except that α-chloroacrylic acid is used instead of methacrylic acid.

6.54% of cyan pigment, as described in Example 3 is blended into the above polyethylmethacrylate-1-chloroacrylic acid copolymer using a 2-roll mill. 40 grams of pigmented polymer and 250 g of Isopar ®-L nonpolar liquid having a Kauri-butanol value of 27, Exxon Corporation are loaded into a Union Process 01 Attritor, Union Process Company, Akron, Ohio, and ground until toner particles with an average size of less than 5 μm are obtained. The toner is diluted to 1.5% and to 1500 grams of this are added 40 grams of 5.5% Basic Barium Petronate ® described in Example 1. The toners are tested on a Savin 870 copier resulting in a right reading image when toner prepared from the above-described copolymer is used and a reverse image when the polyethylmethacrylate-methacrylic acid copolymer (Control resin B of Example 6) is used.

What is claimed is:

1. A liquid electrostatic developer containing negatively chargeable resin particles with improved charging characteristics, said developer consisting essentially of (A) nonpolar liquid having a Kauri-butanol value of less than 30, present in a major amount, (B) nonpolar liquid soluble ionic or zwitterionic charge director compound, and (C) resin particles of a polymer containing at least one acidic constituent having a pKa of less than 4.5 measured at 25° C. in water and an acid number due to said acidic constituent of at least one, the resin particles having an average by area particle size of less than 10 μm.

2. A liquid electrostatic developer according to claim 1 wherein the resin particles are substantially insoluble in nonpolar liquid (A) at temperatures below 40° C.

3. A liquid electrostatic developer according to claim 2 wherein the pKa of at least one acidic constituent is less than 3.0.

4. A liquid electrostatic developer containing negatively chargeable resin particles with improved charging characteristics, said developer consisting essentially of (A) nonpolar liquid having a Kauri-butanol value of less than 30, present in a major amount, (B) nonpolar liquid soluble ionic or zwitterionic charge director compound, and (C) resin particles of a partial ester of 3-hydroxypropanesulfonic acid and a copolymer of ethylene and an α,β-ethylenically unsaturated acid selected from the class consisting of acrylic acid and methacrylic acid having a pKa of less than 4.5 measured at 25° C. in water and an acid number of 7±3 based on 3-hydroxypropanesulfonic acid, the resin particles having an average by area particle size of less than 10 μm.

5. A liquid electrostatic developer according to claim 4 wherein the resin particles are a partial ester of 3-hydroxypropanesulfonic acid and a copolymer of ethylene (89% by weight)/methacrylic acid (11% by weight) having a melt index of 100 at 190° C.

6. A liquid electrostatic developer containing negatively chargeable resin particles with improved charging characteristics, said developer consisting essentially of (A) nonpolar liquid having a Kauri-butanol value of less than 30, present in a major amount, (B) nonpolar liquid soluble ionic or zwitterionic charge director compound, and (C) resin particles of a poly(styrene/2-acrylamido-2-methyl-1-propane sulfonic acid) (95% by weight/5% by weight) having a pKa of less than 4.5 measured at 25° C. in water and an acid number due to said acidic constituent of at least one, the resin particles having an average by area particle size of less than 10 μm.

7. A liquid electrostatic developer according to claim 1 wherein component (A) is present in 85.0 to 99.9% by weight, component (C) is present in 0.1 to 15.0% by weight, based on the total weight of the developer, and component (B) is present in an amount of 1 to 1000 mg/g developer solids.

8. A liquid electrostatic developer according to claim 1 containing up to about 60% by weight of a colorant based on the weight of developer solids.

9. A liquid electrostatic developer according to claim 7 containing up to about 60% by weight of a colorant based on the weight of developer solids.

10. A liquid electrostatic developer according to claim 8 wherein the colorant is a pigment.

11. A liquid electrostatic developer according to claim 10 wherein the percent pigment in the resin is 0.1% to 30% by weight based on the weight of developer solids.

12. A liquid electrostatic developer according to claim 8 wherein the colorant is a dye.

13. A liquid electrostatic developer according to claim 1 wherein the particles have an average by area particle size of less than 5 μm.

14. A liquid electrostatic developer according to claim 1 wherein component (B) is Basic Barium Petronate.

15. A liquid electrostatic developer according to claim 1 wherein component (B) is lecithin.

16. A liquid electrostatic developer containing negatively chargeable resin particles with improved charging characteristics, said developer consisting essentially of (A) nonpolar liquid having a Kauri-butanol value of less than 30, present in a major amount, (B) nonpolar liquid soluble ionic or zwitterionic charge director compound, and (C) resin particles of a polymer having a plurality of fibers extending therefrom, said polymer containing at least one acidic constituent having a pKa of less than 4.5 measured at 25° C. in water and an acid number due to said acidic constituent of at least one, the resin particles having an average by area particle size of less than 10 μm.

17. A liquid electrostatic developer according to claim 1 wherein the resin particles are nonfibrous.

18. A liquid electrostatic developer containing negatively chargeable resin particles with improved charging characteristics, said developer consisting essentially of (A) nonpolar liquid having a Kauri-butanol value of less than 30, present in a major amount, (B) nonpolar liquid soluble ionic or zwitterionic charge director compound, and (C) nonfibrous resin particles of a poly(styrene/2-acrylamido-2-methyl-1-propane sulfonic acid) (95% by weight/5% by weight) containing at least one acidic constituent having a pKa of less than 4.5 measured at 25° C. in water and an acid number due to said acidic constituent of at least one, the resin particles having an average by area particle size of less than 10 μm.

* * * * *